US006242722B1

(12) United States Patent
Provancha et al.

(10) Patent No.: US 6,242,722 B1
(45) **Date of Patent: *Jun. 5, 2001**

(54) TEMPERATURE CONTROLLED THIN FILM CIRCULAR HEATER

(75) Inventors: Kenneth M. Provancha, Soquel; Bernard Feldman, Corralitos, both of CA (US)

(73) Assignee: Thermostone USA, LLC, Salinas, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/345,399

(22) Filed: Jul. 1, 1999

(51) Int. Cl.[7] ..... H05B 3/16

(52) U.S. Cl. ..... 219/543; 118/725; 219/462.1; 219/466.1

(58) Field of Search ..... 219/385, 443.1, 219/452.11, 452.12, 458.1, 462.1, 465.1, 466.1, 467.1, 539, 540, 543, 546; 118/724, 725, 728

(56) References Cited

U.S. PATENT DOCUMENTS

| | | | | |
|---|---|---|---|---|
| 4,002,883 | * | 1/1977 | Hurko | 219/543 |
| 4,808,798 | * | 2/1989 | Goessler et al. | 219/462.1 |
| 4,843,218 | * | 6/1989 | Husslein et al. | 219/466.1 |
| 4,888,467 | * | 12/1989 | Hoffmann | 219/543 |
| 5,019,691 | * | 5/1991 | Lai | 219/543 |
| 5,105,066 | * | 4/1992 | Houdy et al. | 219/385 |
| 5,294,778 | * | 3/1994 | Carman et al. | 219/385 |
| 5,317,132 | * | 5/1994 | Clough et al. | 219/543 |
| 5,352,864 | * | 10/1994 | Schultheis et al. | 219/462.1 |
| 5,616,266 | | 4/1997 | Cooper . | |
| 5,700,992 | * | 12/1997 | Honda et al. | 219/462.1 |
| 5,889,261 | * | 3/1999 | Boardman | 219/543 |
| 5,973,298 | * | 10/1999 | Kallgren | 219/465.1 |

* cited by examiner

*Primary Examiner*—Teresa Walberg
*Assistant Examiner*—Fadi H. Dahbour
(74) *Attorney, Agent, or Firm*—Flehr Hohbach Test Albritton & Herbert LLP

(57) ABSTRACT

A thin film tin-oxide heater (10) including an annular inner heat region (12), an annular outer heat region (14), a first silver buss bar (16), and a second silver buss bar (18). The radius ($r_2$) between the inner and outer heat regions is selected so that the resistance per unit square and power per unit area for the inner heat region approximates the resistance per unit square and power per unit area for the outer heat region.

15 Claims, 4 Drawing Sheets

TEMPERATURE CONTROLLED THIN FILM CIRCULAR HEATER

TECHNICAL FIELD

The present invention relates to the use of thin conductive films in resistance heating applications and, more particularly, to printed heating elements for surface heating applications, such as counter top stoves, which are constructed with large-area circular heating panels that provide even, low-power density, efficient heating.

BACKGROUND ART

U.S. Pat. No. 5,616,266, entitled "Resistance Heating Element with Large Area, Thin Film and Method," issued Apr. 1, 1997 and co-pending patent application, Ser. No. 08/874,524, entitled "Method and Apparatus for Edge Heating of Thin Film Heating Element," filed Jun. 13, 1997, both assigned to assignee of the present patent application, disclose thin film resistance heating elements for use in a variety of oven and space heater applications. The present invention improves upon the design of the thin film heaters disclosed in these patents.

The '266 patent discloses a thin film heater having a metal substrate with a ceramic layer thermally bonded across one side of the metal substrate. An electrically conductive, large area thin metallic film is deposited on the ceramic layer, isolated from the metal substrate. A pair of spaced apart electrical terminals are provided at the ends of the conductive film. Preferably, the conductive film is stannic oxide (tin-oxide) and is deposited onto the ceramic layer as a very thin film of, for example, 2 microns or less. Large area heaters constructed in this manner have been found to be capable of temperatures in excess of 500° F. while allowing operation at high power levels, but lower power densities. Low power densities produce an extremely even heat at lower temperatures without significant hot spots or excessive thermal gradients over the area of the panel.

Co-pending application Ser. No. 08/874,524 discloses a method and apparatus for controlling heat loss at the peripheral edges of heaters of the type disclosed in the '266 patent. A thin film conductive edge heater strip is formed around the peripheral edges of a large area thin film heater and is separately controlled to adjust its heat loss in order to compensate for heat loss at the outer edges of the large area heater. This design can be used in combination with the improved thin film heater of the present invention.

Circular heating elements are conventionally made in the form of a spiral, such as the spiral heating elements of electric stove-top heaters. Circular heaters are employed because most cooking utensils are circular and because a round shape improves the efficiency of the heater by matching more closely the geometry of the load. Thick film heaters, typically 0.001" thick, provide a relatively uniform, low-temperature operating surface. However, a more uniform and lower operating temperature heater is the thin film heater, such as disclosed in the '266 patent. Thin film heaters made from metal oxides, such as tin-oxide, provide long term durability and stability up to approximately 500° C., which is hot enough not only for cooking purposes but for many other purposes as well.

DISCLOSURE OF INVENTION

Briefly described, a first embodiment of the present invention comprises a circular resistance heating element that includes an annular, electrically conductive, thin film outer heat region and an annular, electrically conductive, thin film inner heat region within the outer heat region. A first buss bar separates and electrically connects the inner and outer heat regions and a second buss bar electrically connects to and extends around the outer peripheral edge of the outer heat region and electrically connects to and extends around the inner edge of the inner heat region. With this design, a voltage applied across the first and second buss bars applies the same voltage across the outer heat region and across the inner heat region. In addition, the relative widths of the inner heat region and the outer heat region are determined so that the power dissipated per unit area for the inner and outer heat region film are approximately equal. In this manner, the resistance heating of the circular heater is kept relatively uniform across the surface of the heater and thus the temperature is more uniform than for a single region film.

The invention contemplates the provision of at least two annular heat regions, but provision of additional annular regions increases the uniformity of the heat gradient radially of the heating surface and reduces the current density at the inner diameter of any region.

A second embodiment of the resistance heater of the present invention comprises annular outer and inner heat regions that do not necessarily have to be circular as with the first embodiment, but which are each divided into at least two radially divided sections. The inner and outer heat regions are electrically connected in parallel and each include a first buss bar extending around outer edge of a first section of the heat region (or alternatively around the inner edge of the first section of the heat region), one or more intermediate buss bars electrically interconnecting the first section with subsequent sections, and a final buss bar extending around one of the inner and outer edges of the preceding section and the inner and outer edges of the last subsequent section. The initial intermediate buss bar extends around the edge of the first section that the first buss bar does not extend around, i.e. if the first buss bar extends around the outer edge, then the initial intermediate buss bar extends around the inner edge. The initial intermediate buss bar also extends around the same edge of the next subsequent section, and any additional intermediate buss bars extend around the inner or outer edge of a preceding section not occupied by a preceding buss bar and extend around one of the inner and outer edges of a subsequent section. In other words, the buss bars alternate from inner edges to outer edges of each section so that all sections making up a region are electrically connected in series. A voltage applied across the first and final buss bars applies a fraction of the total voltage across each section of the inner and outer heat regions, first through the first section of each region, and then through subsequent sections. This has the advantage of uniform heat distribution of the first embodiment and also the advantage of lower voltage and resistance per unit square for each section of heating element.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
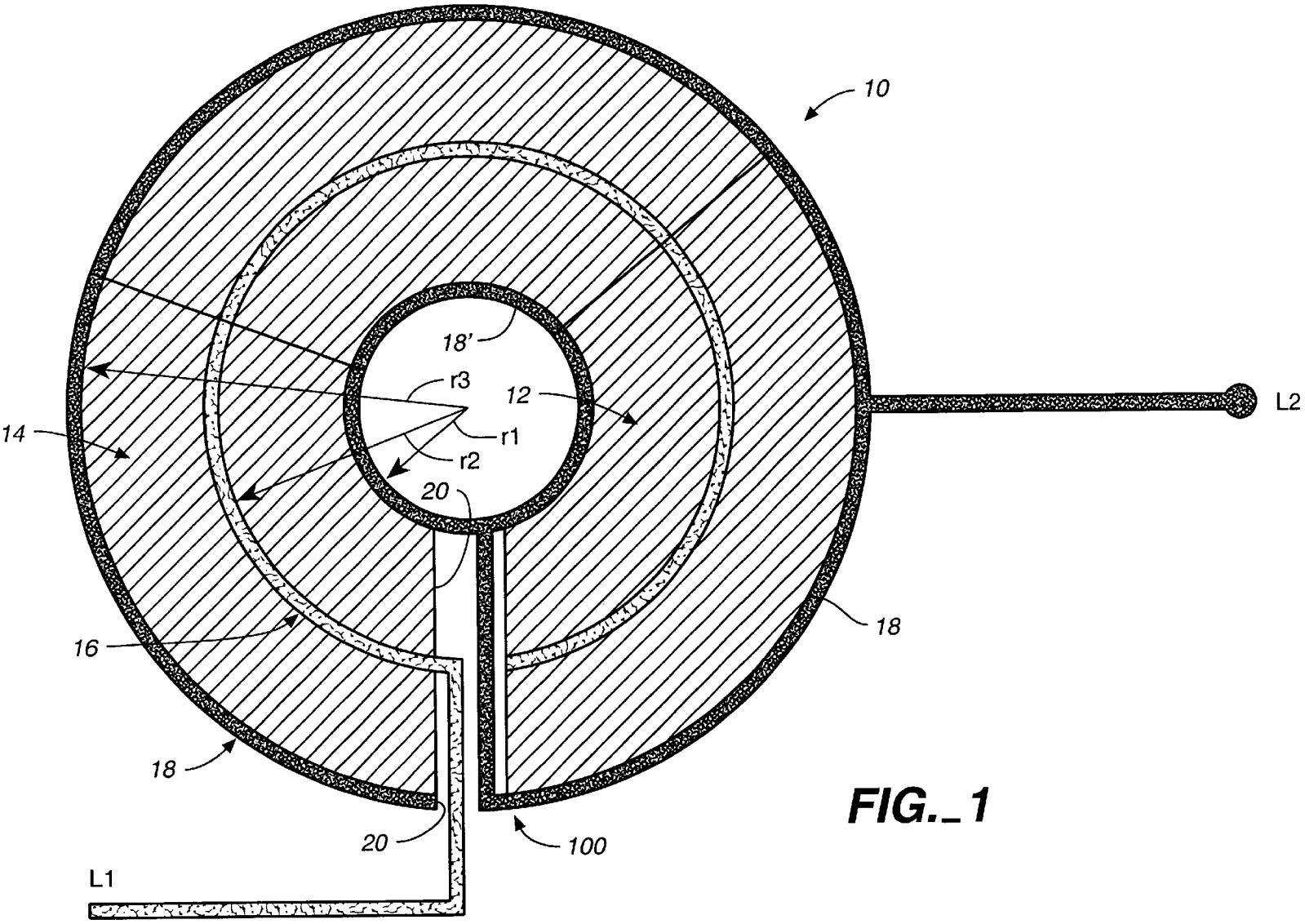
FIG. 1 is a schematic diagram of a first embodiment of the thin film circular resistance heater of the present invention.

Referring to FIG. 1, a first embodiment is shown for a thin film heater 10 of the present invention. Heater 10 is in the form of a circular heater element that is suitable, for example, for a stove top cooking appliance. Heater 10 includes an inner annular thin film heat region 12 and an outer, concentric, annular thin film heat region 14. Inner heat region 12 and outer heat region 14 comprise the heating surface area of heater 10 and both are thin film heating elements formed in the manner discussed in U.S. Pat. No. 5,616,266 and in co-pending patent application Ser. No. 08/874,524. Exemplary manufacturing techniques include spray pyrolysis, chemical vapor deposition, vacuum deposition, sputtering, silk screening, and extrusion techniques.

A first silver buss bar 16 separates inner heat region 12 from outer heat region 14 and is adapted for connection to electrical terminal L1. A radial slot or gap region 20 provides an electrically isolated access path for buss bar 16 to the exterior of heater 10 for connection to terminal L1.

A second silver buss bar 18 surrounds outer heat region 14 and is adapted for connection to electrical terminal L2. Radial slot region 20 also provides an access path for buss bar 18 to extend to the center of inner heat region 12, where a portion of buss bar 18 forms an inner buss bar 18'. The formation of buss bars 16, 18 is also discussed in the forementioned '266 patent and patent application Ser. No. 08/874,524. Typically, the substrate for the heater is masked where the buss bars are to be located, and then the thin film heater material is deposited or printed onto the substrate. A buss bar material, such as ceramic silver consisting of silver flakes, glass frit and a thixotropic screening medium that is burned off in the process of firing the bus bars, is silk screened in place in a manner where the material slightly overlaps the edges of the thin film heater material where electrical contact need be made.

A voltage applied across terminals L1 and L2 applies the same voltage across inner heat region 12, from buss bar 18' to buss bar 16, and also applies the same voltage across outer heat region 14 from buss bar 18 to buss bar 16. However, it is a unique feature of the invention for the resistance per unit square for heat regions be equal so, with properly positioned buss bars, the power per square unit is equal. As a result, the heating across the inner and outer regions is sufficiently uniform. Resistance per unit square is a concept derived from bulk resistivity and is a surface resistivity term for conductive thin films that are uniform in thickness.

To achieve uniform heating, the radial widths of the inner and outer heat regions are determined as follows. The radius $r_1$ of buss bar 18' and the radius $r_3$ of buss bar 18 are selected based on application design criteria. For example, cooktop stove heating elements have diameters ranging from six to twelve inches. Radius $r_1$ can be as minimal as possible given the space requirements for the design of buss bar 18'. For example, buss bar 18' can be reduced to an enclosed circular cul-de-sac, with sufficient space reserved for slot region 20. Because buss bar 18' will always have some radial dimension, $r_1$ can never be zero, although it may approach zero for practical purposes. Radius $r_3$, theoretically, has no limit to its length, although in general the greater the radial width of a heat region, the greater the potential for generating a heating gradient.

Radius $r_2$ of buss bar 16 is selected so that the power per unit area is the same for both the inner and outer heat regions, which ensures generally uniform heating across the inner and outer heat regions. Radius $r_2$ can be calculated as follows:

Let: $N_{12}$=# of squares for the inner heat region $A_{12}$=Area of the inner heat region $N_{23}$=# of squares for the outer heat region $A_{23}$=Area of the outer heat region Then $r_2$ is selected such that:

$$V^2/R_{12}A_{12}=V^2/R_{23}A_{23} \quad (1)$$

where V=voltage; $R_{12}$=resistance of inner heat region; and $R_{23}$=resistance of outer heat region. This is the equation for equal power density for each region.

If $\gamma$=resistance per square unit, and $R=\gamma N$, then $$V^2/\gamma N_{12}A_{12}=V^2/\gamma N_{23}A_{23}$$

Therefore:

$$N_{12}A_{12}=N_{23}A_{23} \quad (2)$$

must be satisfied because a principle feature of the invention is that both the voltage and the resistance per unit square are approximately the same for both the inner and outer heat regions.

Applying basic geometry principles:

$N_{12}=\ln(r_2/r_1)/2\pi$ $N_{23}=\ln(r_3/r_2)/2\pi$ $A_{12}=\pi(r_2^2-r_1^2)$ $A_{23}=\pi(r_3^2-r_2^2)$

Substituting into equation (2)

$$\ln(r_2/r_1)(r_2^2-r_1^2)=\ln(r_3/r_2)(r_3^2-r_2^2) \quad (3)$$

There is always an $r_2$ that satisfies equation (3) for practical heat region designs. Although the example that follows does not take into account the width and spacing of the silver buss bars, this can be accomplished readily and although equation (3) may not be readily solvable, analytically an interactive computer program yields a solution in general.

The following example provides an illustration:

assume $r_1$=1" $r_2$=1.995" $r_3$3"

$N_{12}=\ln(r_2/r_1)=0.6906$ $N_{23}=\ln(r_3/r_2)=0.408$ $A_{12}=(r_2^2-r_1^2)=(1.995^2-1)=2.98$ $A_{23}=(r_3^2-r_2^2)=(9-1.995^2)=5.02$ $N_{12}A_{12}=(0.6906)(2.98)=N_{23}A_{23}=(0.408)(5.02)=2.05$

For an application requiring 1500 watts:

the power across inner heat region: $1500(A_{12})/(A_{12}+A_{23})=559$ watts, and the power across outer heat region: $(1500\times5.02)/8=941$ watts Resistance per unit square $\gamma$ for the inner heat region: $(230^2\times2\pi)/(0.6906\times559)=861$ Resistance per unit square $\gamma$ for the outer heat region: $(230^2\times2\pi)/(0.408\times941)=866$ For some applications, 115 volts and 216 ohms/square approach the upper limit of stable operation of some thin films. One potential solution to this problem is dropping the voltage via a gated triac and fusing the circuit. The insulation provided by the insulating substrate between the user and the voltage source should satisfy electrical codes. Protection against a broken cooktop, for example, which could expose a user to voltage, can be provided by a GFI. The lower voltage Ground Fault Interrupter also prevents leakage and dielectric breakdown.

Figure 2:
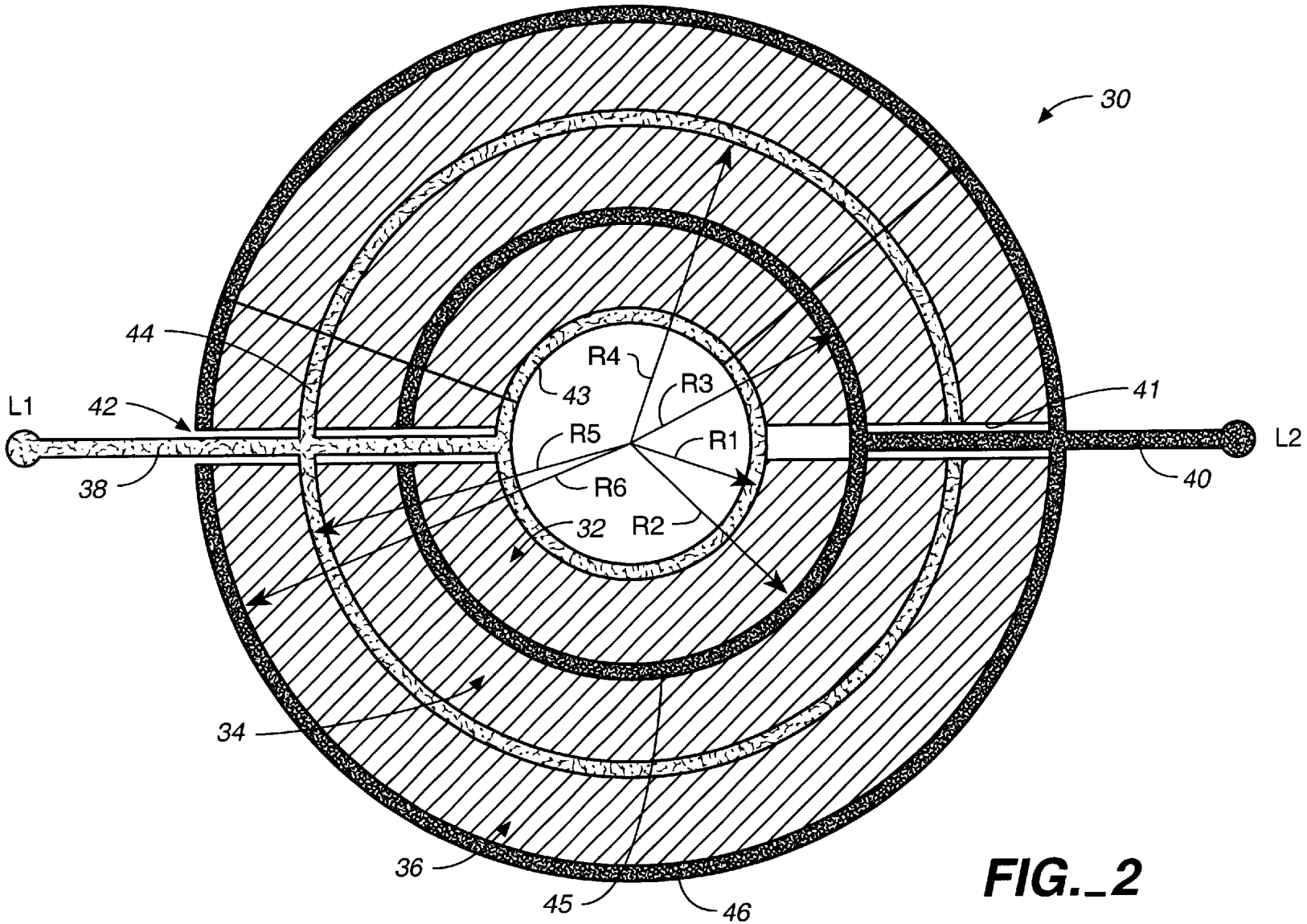
FIG. 2 is a schematic diagram of an alternative embodiment of the thin film circular resistance heater of FIG. 1.

FIG. 2 shows an alternative embodiment for a thin film heater that achieves more uniform heat distribution radially across the heater element. The hot regions of a heat region form along the inner areas of the heating element, where current densities are greater. Provision of three or more heat regions improves uniform heat distribution, but for many applications, however, two regions may be sufficient.

Heater 30 of FIG. 2 includes an inner heat region 32, an intermediate heat region 34, and an outer heat region 36. A first buss bar 38 extends through a radial gap 42 and includes an outer ring 44 and an inner ring 43. A second buss bar 40 extends through a radial gap 41 and includes an inner ring 45 and an outer ring 46.

As an example of the heating efficiency of heater 30, the following is provided:

Let $A_1$, $A_2$, and $A_3$ be the areas of the inner, intermediate and outer heat regions, respectively, $P_{1-3}$ be the power of each region, and $\gamma_{1-3}$ be the resistance per unit square for each region.

Then, for the same inner and outer radii of FIG. 1, $A_1$=1.5 in$^2$ (32)

$A_2$=2.325 in$^2$ (34)

$A_3$=3.177 in$^2$ (36)

$P_1$=1.5(1500)/7=321 watts $P_2$=2.235(1500)/7=498 watts $P_3$=3.007(1500)/7=681 watts $Ln_1(1.581)=0.458$ $Ln_2(2.288/1.706)=0.2935$ $Ln_3(3/2.413)=0.2177$ $\gamma_1=230^2(2\pi)/(0.4581)(321)=2260$ ohms/sq.

$\gamma_2=2274$ $\gamma_3=2242$ $R_1=1.0$ $R_2=1.581$ $R_3=1.706$ $R_4=2.288$ $R_5=2.413$ $R_6=3.0$ Where $R_{1-6}$ are in inches and each bus bar is ⅛ inch in width.

Thus, $\gamma_1=\gamma_2=\gamma_3$, within less than 1% of one another due to rounding errors in the above example.

Figure 3:
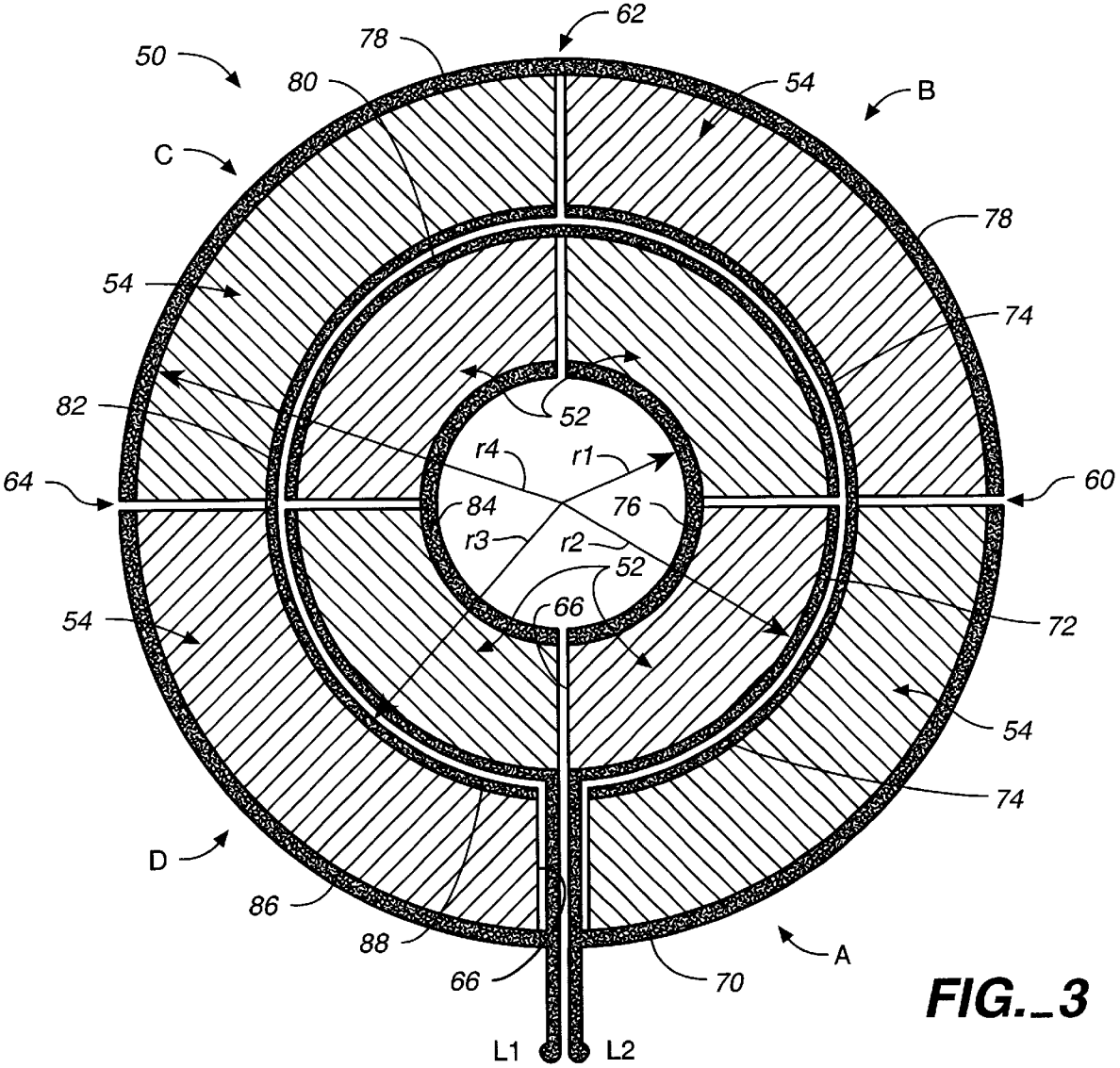
FIG. 3 is a schematic diagram of a second embodiment of the thin film circular resistance heater of the present invention.

Another alternative embodiment for reducing the required resistance per unit square of a thin film heating element is shown in FIG. 3. A thin film heater 50 has an inner heat region 52 and an outer heat region 54 and is divided into 4 sections or quadrants A, B, C, and D by narrow radial slots or gaps 60, 62, 64, and 66. Electrical terminal L2 connects to a first silver buss bar 70 along the outer edge of outer heat region 54 of quadrant A and to a first buss bar 72 along the outer edge of inner heat region 52 of quadrant A. The choice of buss bars 72, 74 extending initially along the outer edges, rather than the inner edges, of the inner and outer heat regions of quadrant A is arbitrary and can be reversed.

A second buss bar 74 extends along the inner edge of outer heat region 54 in both quadrants A and B and, thus, electrically connects the outer region heating elements of both quadrants A and B. Another second buss bar 76 extends along the inner edge of inner heat region 52 in both quadrants A and B. Third buss bars 78, 80 electrically connect the heating elements of quadrant B to quadrant C, and fourth buss bars 82, 84 electrically connect the heating elements of quadrant C to quadrant D. Finally, fifth buss bars 86, 88 connect both the inner and outer heat regions to terminal L1.

The alternating inner-edge/outer-edge positions of subsequent buss bars, for example buss bars 70, 74, 78, 82, and 86, creates a voltage drop across each heating element section for both the inner and outer heat regions. Thus, for example, a voltage of 230V applied across terminals L1 and L2 applies approximately 57.5V across each heating element section. Reducing the voltage by a factor of four reduces the required resistance per unit square by a factor of 16 and allows for improved stable operation of many types of thin film heating elements since the resistance per unit square can be lower.

For the embodiment illustrated by FIG. 3, since each section A, B, C, D receives the same voltage, the relative widths of the heating elements of the inner and outer heat regions can be selected, in a manner similar to selecting $r_2$ of the heating element of the first embodiment of FIG. 1, to ensure that the power/area of any section and region is the same.

For this, equation (1) above is modified to:

$$V^2/R_{12}A_{12}=V^2/R_{34}A_{34} \tag{4}$$

and equation (2) above is modified to:

$$N_{12}A_{12}=N_{34}A_{34} \tag{5}$$

The geometry of the heating element of each sections changes slightly:

$$N_{12}=2\times\ln(r_2/r_1)/\pi$$

$$N_{23}=2\times\ln(r_4/r_3)/\pi$$

$$A_{12}=\pi(r_2^2-r_1^2)$$

$$A_{23}=\pi(r_4^2-r_3^2)$$

where radius $r_1$ is the radius of the circular path defined by buss bars 76, 84; radius $r_2$ is the radius of the circular path defined by buss bars 72, 80, 88; radius $r_3$ is the radius of the circular path defined by buss bars 74, 82; and radius $r_4$ is the radius of the circular path defined by buss bars 70, 78, 86.

Modified equation (3) then becomes:

$$\ln(r_2/r_1)(r_2^2-r_1^2)=\ln(r_4/r_3)(r_4^2-r_3^2) \tag{6}$$

Depending on the width of the buss bars and the width of the gaps between adjacent buss bars, radius $r_3$ can vary relative to radius $r_2$, but is proportional thereto. Thus, $r_3=K+r_2$, where K is equal to the widths of, for example, buss bars 82, 88 added together plus the width of the gap therebetween. As an example, buss bars 82, 88 may each have a width of approximately ⅛ inch and the gap therebetween may have a width of ⅛–¼ inch.

Again, there is always an $r_2$ (and an $r_3$) that satisfies equation (6) for practical heater designs, and these radii can be calculated via a cut and try computer program.

Since the voltage across the heating elements is cut by a factor of 4, the resistance per unit square is cut by a factor of 16, since resistance is inversely proportional to voltage squared.

Figure 4:
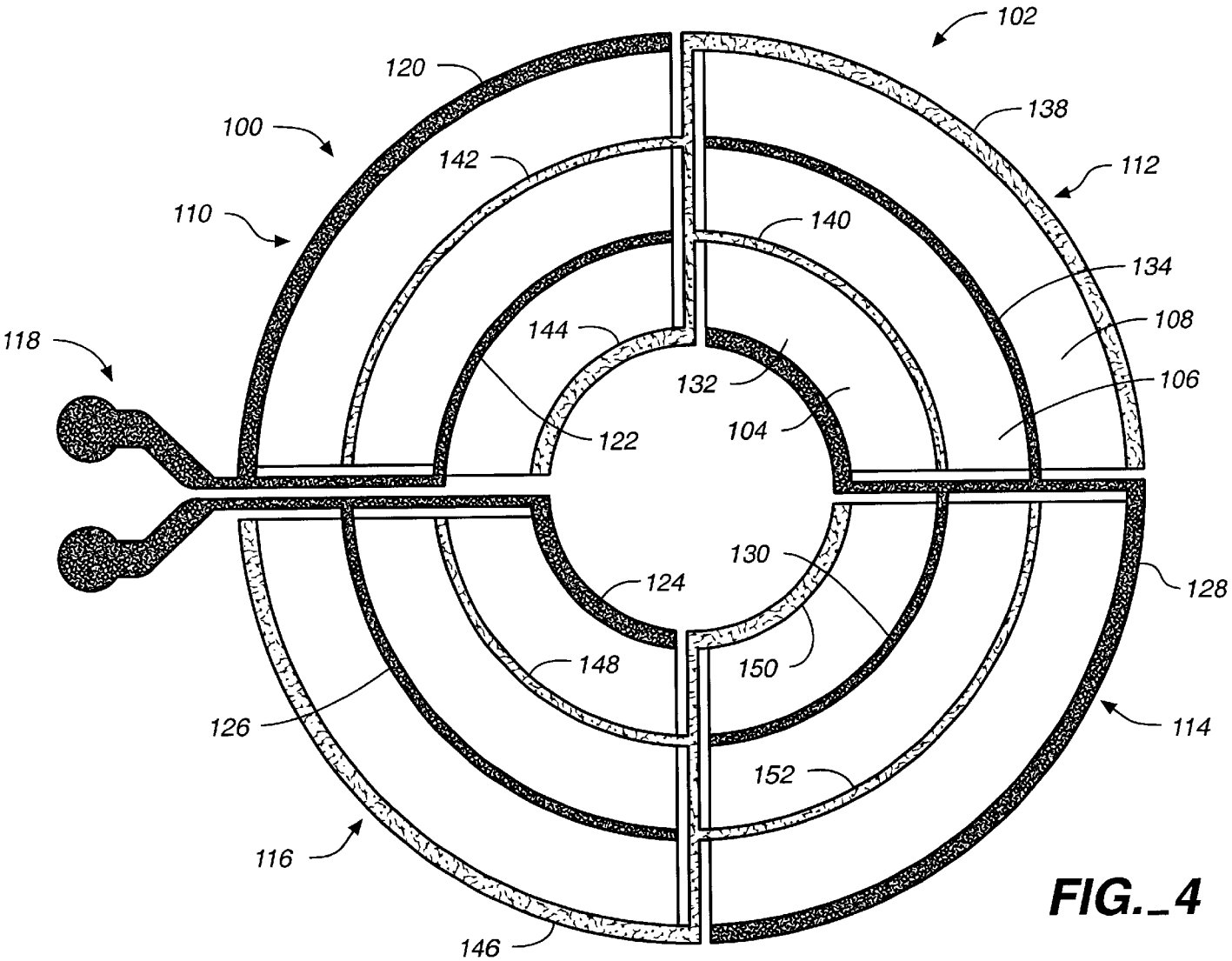
FIG. 4 is a schematic diagram of an alternative embodiment of the thin film circular resistance heater of FIG. 3.

FIG. 4 shows an additional buss bar configuration 100 with a similar 3-region design as the heater of FIG. 2. Circular, thin film heater 102 includes three circular regions 104, 106, 108, and is divided into four quadrants 110, 112, 114, 116. Leads $L_1$ includes buss bars 120, 122 and lead $L_2$ includes buss bars 124, 126. Intermediate buss bars 128, 130, 132, 134, 138, 140, 142, 144, 146, 148, 150, 152. Circular heater 102 is broken up into radial sectors or quadrants and the buss bars are connected in series in a manner similar to that shown in FIG. 3.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto when read and interpreted according to accepted legal principles such as the doctrine of equivalents and reversal of parts.

What is claimed is:

1. A circular resistance heating element comprising an annular, electrically conductive, thin film outer heat region, an annular, electrically conductive, thin film inner heat region within the outer heat region, the outer and inner heat regions having thin films with the same resistance per unit square within coating tolerances of the thin film inner and outer heat regions, a first buss bar separating and electrically connecting the inner and outer heat regions, a second buss bar electrically connected to and extending around the outer peripheral edge of the outer heat region and electrically connected to and extending around the inner edge of the inner heat region, whereby a voltage applied across the first and second bus bars is applied across the outer heat region and across the inner heat region, and wherein the relative widths of the inner heat region and the outer heat region are different and are selected such that the power per unit area for the inner and outer heat regions is equal.

2. A circular resistant heating element comprising:

an annular, electrically conductive, thin film outer heat region, an annular, electrically conductive, thin film inner heat region within the outer heat region, the outer and inner heat regions having thin films with the same resistance per unit square within coating tolerances of the thin film inner and outer heat regions, a first buss bar separating and electrically connecting the inner and outer heat regions, a second buss bar electrically connected to and extending around the outer peripheral edge of the outer heat region and electrically connected to and extending around the inner edge of the inner heat region, the inner and outer heat regions being circular and the radius of the second buss bar extending around the inner edge of the inner heat region ($r_1$), the radius of the second buss bar extending around the outer edge of the outer heat region ($r_3$), and the radius ($r_2$) of the first buss bar satisfy the following equation:

$$\ln(r_2)/r_1)(r_2^2-r_1^2)=\ln(r_3/r_2)(r_3^2-r_2^2)$$

whereby a voltage applied across the first and second buss bars is applied across the outer heat region and across the inner heat region, and wherein the relative widths of the inner heat region and the outer heat region are such that the power per unit area for the inner and outer heat regions is equal.

3. The heater of claim 1 wherein, the inner and outer heat regions are circular and are concentric.

4. The heater of claim 3 wherein, the inner and outer heat regions are formed by quadrants each with inner and outer heat region segments.

5. A circular, resistance heater comprising, an annular, electrically conductive, thin film outer heat region, an annular, electrically conductive, thin film inner heat region within the outer heat region, the inner and outer heat regions each being divided into at least two sections, each inner and outer heat region including (a) a first buss bar extending around one of the inner and outer edges of a first section of the heat region, (b) one or more intermediate buss bars electrically interconnecting the first section with subsequent sections, the initial intermediate buss bar extending around the other of said inner and outer edges of the first section and also extending around one of the inner and outer edges of the next subsequent section, and any additional intermediate buss bars extending around the inner or outer edge of a preceding section not occupied by a preceding buss bar and extending around one of the inner and outer edges of a subsequent section, and (c) a final buss bar extending around one of the other of said inner and outer edges of the preceding section and the other of said inner and outer edges of the last subsequent section, whereby a voltage applied across the first and final buss bars applies a fraction of the voltage across each section of the inner and outer heat regions, first through the first section of each region, and then through subsequent sections.

6. The heater of claim 5 wherein, the relative widths of the inner and outer heat regions are such that the resistance per unit square for each section of the inner and outer heat regions is approximately equal while the power per unit area is also equal.

7. The heater of claim 6 wherein, the inner and outer heat regions are each divided into sections by radial gaps.

8. The heater of claim 7 wherein, the sections of the inner heat region are defined by the same radial gaps as define the sections of the outer heat region.

9. The heater of claim 8 wherein, each section of the inner heat region corresponds with a section of the outer heat region, and the arcuate lengths of the corresponding sections are approximately equal.

10. The heater of claim 5 wherein, the inner and outer heat regions are circular and are concentric.

11. The heater of claim 10 wherein, the intermediate buss bar extends along a common radius.

12. The heater of claim 11 wherein, the inner edges of each section of the inner heat region extend along a common radius ($r_1$), and the outer edges of each section of the inner heat region extend along a common radius ($r_2$), and the inner edges of each section of the outer heat region extend along a common radius ($r_3$), and the outer edges of each section of the outer heat region extend along a common radius ($r_4$).

13. The heater of claim 12 wherein radii ($r_1$), ($r_2$), ($r_3$), and ($r_4$) are chosen so that the following equation is satisfied:

$$\ln(r_2/r_1)(r_2^2-r_1^2)=\ln(r_4/r_3)(r_4^2-r_3^2).$$

14. A resistance heater comprising an annular, electrically conductive, thin film outer heat region, an annular, electrically conductive, thin film inner heat region within the outer heat region, the inner and outer heat regions being divided into at least two sections, a first buss bar electrically connected to and extending around one of the inner and outer edges of a first section of each inner and outer heat region, a second buss bar electrically connected to and extending around the other of said inner and outer edges of the first section of each inner and outer heat region, and also extending around and electrically connected to one of the inner and outer edges of a second section of each inner and outer heat region, and a third buss bar electrically connected to and extending around the other of said inner and outer edges of the second section of each inner and outer heat region, whereby a voltage applied across the first and third buss bars applies a fraction of the voltage across each section of the inner and outer heat regions.

15. The heater of claim 14 wherein, the relative widths of the sections of the inner and outer heat regions are such that the resistance per unit square and power per unit area for each section is approximately equal.

* * * * *